US006483527B2

(12) United States Patent
Kaneko et al.

(10) Patent No.: US 6,483,527 B2
(45) Date of Patent: Nov. 19, 2002

(54) IMAGE FORMING APPARATUS FOR FORMING A COLOR IMAGE USING A PLURALITY OF IMAGE FORMING PARTS

(75) Inventors: Tamotsu Kaneko, Shizuoka-ken (JP); Yoshiharu Irei, Fujisawa (JP); Jun Nakao, Mishima (JP); Yasunori Omori, Toride (JP); Takayuki Miyamoto, Shizuoka-ken (JP); Isao Matsuoka, Susono (JP); Yuji Teramura, Hikone (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/785,182

(22) Filed: Feb. 20, 2001

(65) Prior Publication Data

US 2001/0031152 A1 Oct. 18, 2001

(30) Foreign Application Priority Data

Feb. 29, 2000 (JP) ..... 2000-054535
Dec. 20, 2000 (JP) ..... 2000-386386

(51) Int. Cl.[7] ..... B41J 2/435; B41J 2/385; G03G 15/00

(52) U.S. Cl. ..... 347/138; 347/152; 347/263; 399/107; 399/110

(58) Field of Search ..... 399/107, 110, 399/111, 118, 116; 347/138, 152, 263, 245

(56) References Cited

U.S. PATENT DOCUMENTS 5,552,857 A * 9/1996 Ishikawa ..... 347/152
5,758,243 A * 5/1998 Haneda et al. ..... 399/111
6,236,820 B1 * 5/2001 Nakazato et al. ..... 347/138
6,278,471 B1 * 8/2001 Uchiyama et al. ..... 347/138
6,396,524 B1 * 5/2002 Cooper et al. ..... 347/138

* cited by examiner

*Primary Examiner*—Susan S. Y. Lee
(74) *Attorney, Agent, or Firm*—Fitzpatrick, Cella, Harper & Scinto

(57) ABSTRACT

An image forming apparatus includes a plurality of image bearing components and a plurality of image writing units for writing an image on each of the image bearing components. The apparatus also includes a frame for supporting the plurality of the image bearing components and the plurality of image writing units. The frame has a plurality a of first holding parts for holding both ends of each of the image bearing components and a plurality of second holding parts for holding both ends of each of the image writing units.

19 Claims, 8 Drawing Sheets

IMAGE FORMING APPARATUS FOR FORMING A COLOR IMAGE USING A PLURALITY OF IMAGE FORMING PARTS

BACKGROUND OF THE INVENTION

1. Field of the Invention

The present invention relates to an image forming apparatus of a copying machine, a printer and the like, and more particularly, to an image forming apparatus for forming a color image using a plurality of image forming parts.

2. Related Background Art

As shown in FIGS. 12A and 12B, there is a conventional full color image forming apparatus of the in-line type which has a plurality of photosensitive drums arranged in line. There are mainly two kinds of such full color image forming apparatuses. One is an image forming apparatus 200A of the horizontal arrangement type which has a plurality of photosensitive drums horizontally arranged in line as shown in FIG. 12A and the other is an image forming apparatus 200B of the vertical arrangement type which has a plurality of photosensitive drums vertically arranged in line as shown in FIG. 12B. Their features are that the image forming apparatus 200A of the horizontal arrangement type is short in height but requires a large area for installation, while that the image forming apparatus 200B of the vertical arrangement type requires a small area for installation but is tall in height.

In an in-line full color image forming apparatus, parallelism of each photosensitive drum 201 and accuracy in position between a scanner unit 202 and the drum are, always considered to be very important in light of an image color aberration.

Conventionally, as the image forming apparatus 200B of the vertical arrangement type shown in FIG. 14, the photosensitive drum 201 is positioned by being abutted to a drum support block 204 mounted on each of right and left side plates 203*a* and 203*b* with accuracy.

The scanner unit 202 is positioned by being mounted on a scanner stand 205 so as to bridge the right and left side plates 203*a* and 203*b* and being secured on the scanner stand 205 by screws with accuracy.

In a conventional color printer, the most important problem has been a tilt aberration of each color in a printed image. As shown in FIG. 13, when black (Bk) and magenta (M) are recorded in superposed relation, a tilt between the photosensitive drums of the colors and a tilt of the scanner unit from the photosensitive drum directly appear on the image as the tilt aberration G. Namely, when the parallelism of four photosensitive drums is lost, the tilt aberration G of each color occurs on the printed image. In addition, when parallelism of an optical axis of the scanner unit and an axis of each photosensitive drum is lost, the tilt aberration G of each color occurs on the printed image likewise.

Conventionally, as shown in FIG. 14, in order to obtain accuracy in position of a plurality of the photosensitive drums 201 and the scanner units 202, the drum support blocks 204 are used in all four parts to assure parallelism of the photosensitive drums. For the scanner unit 202, parallelism of the scanner stand 205 is strictly defined or the plate is thickened in order to strengthen rigidity or the like so as to improve accuracy and strength of components.

In case where improving accuracy of the component is not sufficient, during assembly, a master tool which has an assured positional relationship is used to adjust a position of the scanner stand 205 whereto the drum support block 204 and the scanner 202 are mounted. There is another means such that the position is adjusted by an adjustment mechanism which can make fine adjustment to the assembly. Generally used as an adjustment method is a mechanical adjustment mechanism using a cam or a lever.

In the above described means, however, there is a limit in strictly defining the accuracy of the component and assuring the position. It is generally said that amount of color aberration accepted in the color printer is 100 $\mu$m, and the color aberration in this configuration should be within tens of $\mu$m in spite of various factors of the color aberration. For this reason, each component has to be manufactured in the accuracy of some $\mu$m, which requires impracticable measurement defining in the drum support block 204 and the scanner stand 205.

Further, assembly by adjustment and fine adjustment in position cause an increase in cost and requires time-consuming adjustment, which is a serious disadvantage for products such as printers to be mass produced.

SUMMARY OF THE INVENTION

The present invention is made in view of the above problems and an object of the present invention is to provide an image forming apparatus which forms images with good quality.

An another object of the present invention is to provide an image forming apparatus with high accuracy in mutual position of a plurality of image forming portions.

A still another object of the present invention is to provide an image forming apparatus comprising:

a plurality of image bearing members;

a plurality of image writing means for writing an image onto: each of said image bearing member; and a frame for supporting a plurality of said image bearing members and a plurality of said image writing means, said frame having a plurality of first holding parts which hold both ends of each of said image bearing body and a plurality of second holding parts which hold both ends of each of said image writing means.

Further objects of the present invention will become more apparent upon a reading of the following detailed description with reference to the drawings.

DESCRIPTION OF THE PREFERRED EMBODIMENTS

An image forming apparatus according to the present invention will be described below with reference to the drawings.

<Embodiment 1>

First, a whole configuration of a full color image forming apparatus will be described with reference to FIG. 1.

Figure 1:
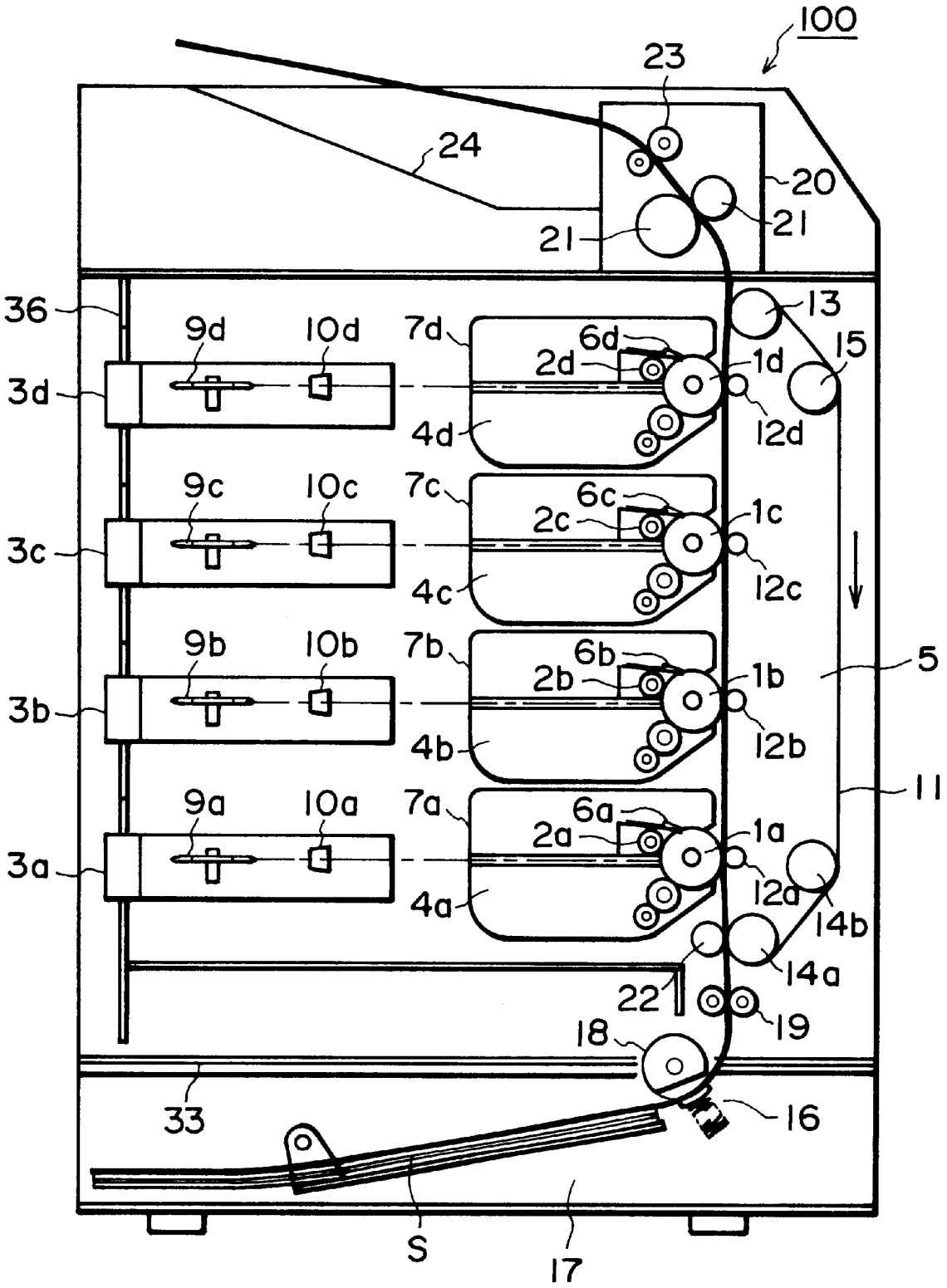
FIG. 1 is a sectional view of an image forming apparatus according to a first embodiment of the present invention.

FIG. 1 is a vertical sectional view showing the whole configuration of a full color image forming apparatus 100 (a full color laser beam printer). The illustrated full color image forming apparatus 100 is provided with four photosensitive drums 1 (1*a*, 1*b*, 1*c*, 1*d*) vertically arranged in line and each drum 1 is rotatably driven in a counterclockwise direction in FIG. 1 by driving means (not shown). Around the photosensitive drums 1, there are provided charging apparatuses 2 (2*a*, 2*b*, 2*c*, 2*d*) for evenly charging a surface of the photosensitive drum 1, scanner units 3 (3*a*, 3*b*, 3*c*, 3*d*) for irradiating a laser beam based on an image information to form an electrostatic latent image on the photosensitive drum 1, developing apparatuses 4 (4*a*, 4*b*, 4*c*, 4*d*) for having toner adhered on the electrostatic latent image to be developed as a toner image, an electrostatic transferring apparatus 5 for transferring the toner image on the photosensitive drum 1 to a transfer material S, and cleaning apparatuses 6 (6*a*, 6*b*, 6*c*, 6*d*) for removing remaining toner on a surface of the photosensitive drum 1 after transferring.

Here, the photosensitive drums 1, charging apparatuses 2, developing apparatuses 4 and cleaning apparatuses 6 are formed integral with each other to be in a form of a cartridge to form process cartridges 7 (7*a*, 7*b*, 7*c*, 7*d*).

Description will be made below in turn from the photosensitive drum 1.

The photosensitive drum 1 is configured as being in a layer by, for example, applying an organic photo-conductive material (an OPC photosensitive material) on an outer peripheral surface of an aluminum cylinder 30 mm in diameter. The photosensitive drum 1 is rotatably supported at its both ends by support members and rotatably driven in a counterclockwise direction in FIG. 1 by driving force transferred from driving motor (not shown) to its one end.

As the charging apparatus 2, the apparatus of the contact charging type can be used. A charging member is formed from an electro-conductive roller in the shape of a roller and the surface of the photosensitive drum 1 can be evenly charged by abutting the electro-conductive roller 2 on the surface of the photosensitive drum 1 and applying a charging bias voltage on the electro-conductive roller 2.

The scanner unit 3 is arranged substantially in a horizontal direction of the photosensitive drum 1 and an image light in response to an image signal is irradiated by a laser diode (not shown) to polygon mirrors 9 (9*a*, 9*b*, 9*c*, 9*d*) rotated at a high speed by a scanner motor (not shown). The image light reflected by the polygon mirror 9 is irradiated to the surface of the charged photosensitive drum 1 via image forming lenses 10 (10*a*, 10*b*, 10*c*, 10*d*) to form an electrostatic latent image on the photosensitive drum 1.

Each of the developing apparatus 4*a*, 4*b*, 4*c*, 4*d* is configured by a developing apparatus which accommodates toner of yellow, magenta, cyan and black, respectively.

An electrostatic transferring belt 11 is arranged which moves in circulation so as to contact opposite all the photosensitive drums 1*a*, 1*b*, 1*c*, 1*d* and the electrostatic transferring belt 11 is configured from film members approximately 150 $\mu$m thick having a volume resistivity of $10^{11}$ to $10^{14}$ $\Omega$·cm. The electrostatic transferring belt 11 is supported by rollers 13, 14*a*, 14*b*, 15 at vertical four axes and moves in circulation so as to electrostatically attach the transfer materials S to an outer peripheral surface at a left side in FIG. 1 to contact the transfer material S to the photosensitive drum 1. According to this, the transfer material S is transported to a transfer position by the electrostatic transferring belt 11 and the toner image on the photosensitive drum 1 is transferred thereto.

Inside the electrostatic transferring belt 11, transferring rollers 12 (12*a*, 12*b*, 12*c*, 12*d*) are arranged in line opposite four photosensitive drums 1*a*, 1*b*, 1*c*, 1*d*. Positive charge from these transferring rollers 12 are applied to the transfer material S via the electrostatic transferring belt 11 and electric field by this charge transfers a negative toner image on the photosensitive drum 1 to the transfer material S contacting the photosensitive drum 1.

Here, the electrostatic transferring belt 11 is configured from an endless belt approximately 700 mm peripheral length and 150 $\mu$m thick, arranged around the driving roller 13, driven rollers 14*a*, 14*b* and tension roller 15 and rotatably driven in the direction of arrow of FIG. 1. Then, the toner image is transferred to the transfer material S during circulation movement of the electrostatic transferring belt 11 such that the transfer material S is transported from the driven roller 14*a* side to the driving roller 13 side.

A sheet feeding part 16 is provided for feeding and, transporting the transfer material S to the image forming part and accommodates a plurality of transfer materials S in a sheet feeding cassette 17. During image forming, a sheet feeding roller 18 (a hemispherical roller) and a pair of registration rollers 19 are rotatably driven in response to image forming operation and the transfer materials S in the feeding cassette 17 are separately fed one by one. The transfer material S stops when abutting at its tip against the pair of registration rollers 19, and after forming a loop, it is fed to the electrostatic transferring belt 11 by the pair of registration rollers 19 such that the rotation of the electrostatic transferring belt 11 synchronizes with an image writing position.

A fixing part 20 is provided for fixing toner images of plural colors transferred to the transfer material S, and consists of a rotating heating roller 21*a* and a pressurizing roller 21*b* welded with pressure thereto to heat and to pressurize the transfer material S.

Accordingly, the transfer material S to which the toner image on the photosensitive drum 1 is transferred is transported by the heating roller 21*a* and pressurizing roller 21*b* during passing through the fixing part 20 and heated and pressurized by the heating roller 21*a* and pressurizing roller 21*b*, whereby the toner image with plural colors are fixed on the surface of the transfer material S.

For image forming operation, the process cartridges 7*a*, 7*b*, 7*c*, 7*d* in turn are driven in a timed relationship with printing, and the photosensitive drums 1*a*, 1*b*, 1*c*, 1*d* are rotatably driven in a counterclockwise direction. Then, the scanner units 3*a* to 3*d* corresponding to the process cartridges 7*a* to 7*d* in turn are driven, the charging rollers 2*a* to 2*d* apply even charge on the peripheral surface of the photosensitive drums 1*a* to 1*d*, and the scanner units 3*a* to 3*d* expose the peripheral surfaces of the photosensitive drums 1*a* to 1*d* in response to the image signal to form the electrostatic latent image on the peripheral surface of each of the photosensitive drums 1*a* to 1*d*. The developing rollers in the developing apparatuses 4*a* to 4*d* transfer the toner to a low potential portion of the electrostatic latent image to form (develop) the toner image on the peripheral surface of the photosensitive drums 1*a* to 1*d*.

When the tip of the toner image on the peripheral surface of the most upstream photosensitive drum la is rotarily transported to an opposite point opposite the electrostatic transferring belt 11, the pair of registration rollers 19 start rotating to feed the transfer material S to the electrostatic transferring belt 11 in such a manner that the printing start position of the transfer material S coincides with the opposite point.

The transfer material S is welded with pressure on the, periphery of the electrostatic transferring belt 11 such as to be nipped by an electrostatic attaching roller 22 and the electrostatic transferring belt 11. A voltage is applied between the electrostatic transferring belt 11 and the electrostatic attaching roller 22, which induces charge on the transfer material S which is a dielectric material and a dielectric material layer of the electrostatic transferring belt 11 so that the transfer material S is electrostatically attached to the outer periphery of the electrostatic transferring belt 11. According to this, the transfer material S is stably attached to the electrostatic transferring belt 11 and transported to the most downstream transferring part.

While the transfer material S is transported in such ways, the toner image of each of the photosensitive drums 1*a* to 1*d* in turn is transferred thereto by the electric field formed between the photosensitive drums 1*a* to 1*d* and the transferring rollers 12*a* to 12*d*.

The transfer material S having four color toner images transferred is separated from the electrostatic transferring belt 11 by curvature of the belt driving roller 13 to be transported in the fixing part 20. The transfer material S is subjected to heat fixing of the toner image in the fixing part 20 and then discharged from the sheet discharging part 24 out of the apparatus by a pair of sheet discharging rollers 23 with the image surface down.

Figure 2:
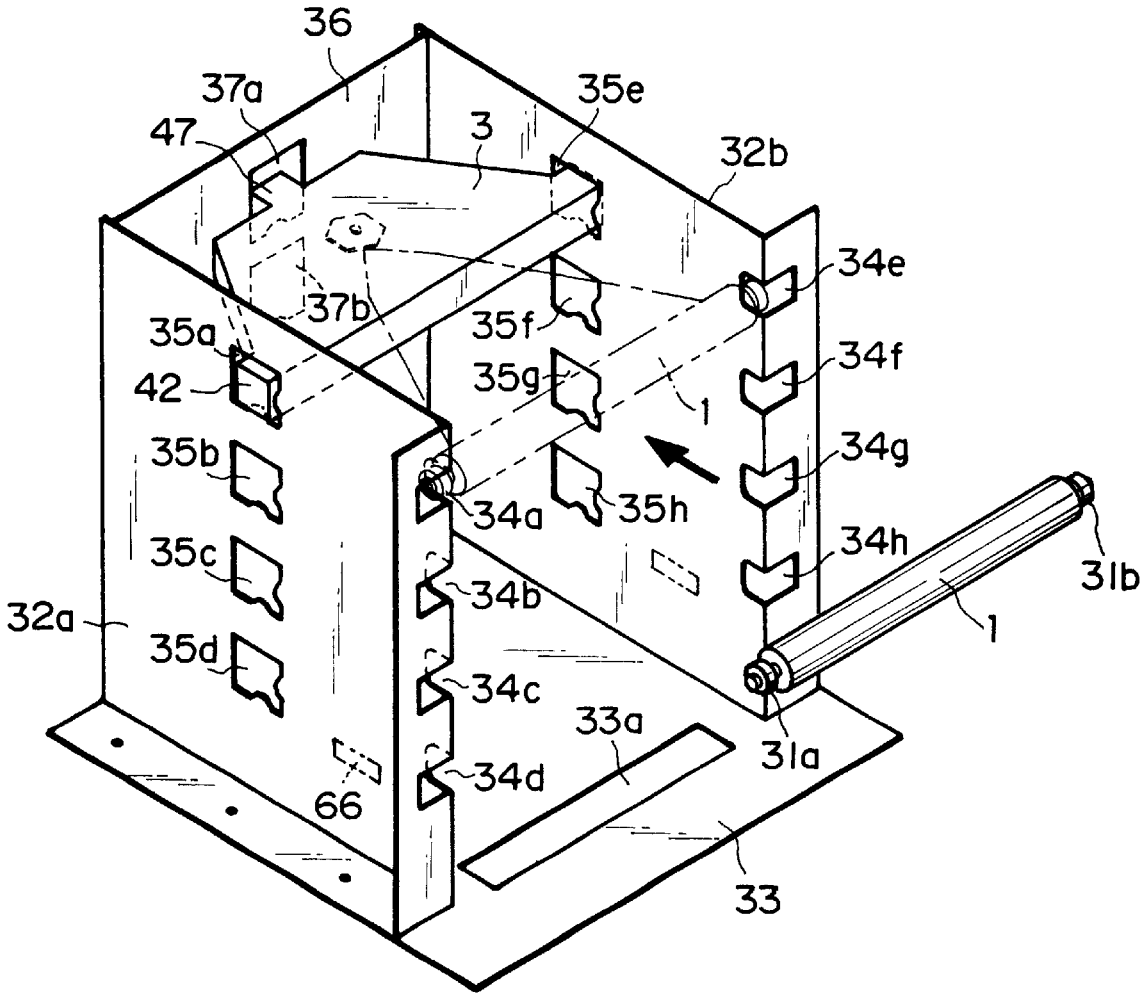
FIG. 2 is a perspective view showing a configuration of a body frame of the image forming apparatus according to the first embodiment of the present invention.
Figure 3:
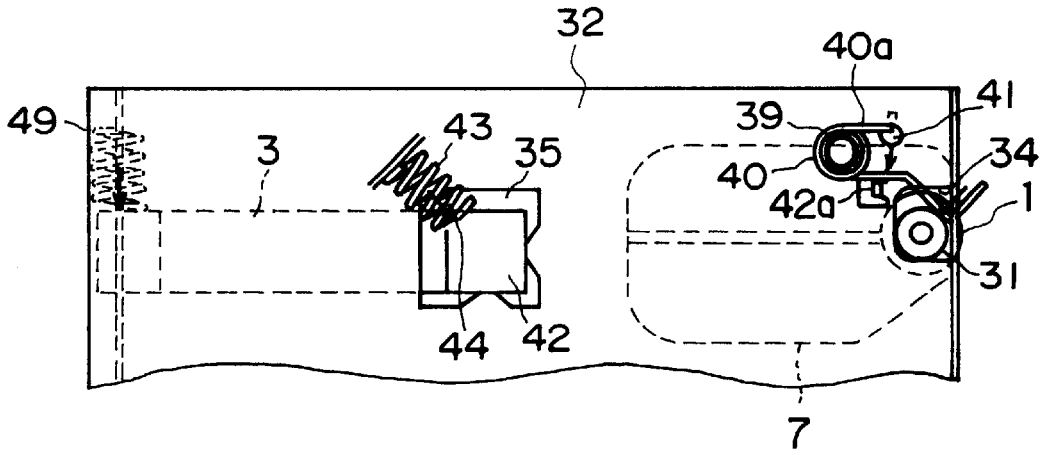
FIG. 3 is a side view partly showing a positioning structure of a photosensitive drum and a scanner unit of the image forming apparatus according to the first embodiment of the present invention.

Next, a configuration of a body frame will be described with reference to FIGS. 2 and 3 which is the characteristic part of the present invention. FIG. 2 is a perspective view of the body frame and FIG. 3 is a sectional view of part of the body frame.

As shown in FIG. 2, a bearing 31 (31*a*, 31*b*) is fitted to longitudinal both ends of the photosensitive drum 1, which is rotatably mounted via the bearing 31 (31*a*, 31*b*). The bearing 31 is axially defined by an E-ring (not shown). In FIG. 2, only the photosensitive drum 1 and the bearing 31 are shown in order to describe the configuration of the present invention to be easily understood.

A left side plate 32*a* and a right side plate 32*b*, which are bent outwardly at their lower portion and secured to the bottom plate 33 by screws from the above, are arranged in a position where they abut the outer peripheral surface of the bearing 31. A pitch between the left and right side plates 32*a* and 32*b* is important and in order to define the pitch, a size in a wide direction and the parallelism of the positioning portions of the left and right side plates 32*a* and 32*b* are strictly defined on the bottom plate 33. The bottom plate 33 is formed from a plate like the left and right side plates 32*a* and 32*b*, and the bottom plate 33 is formed at their front with a sheet passing hole 33*a* through which the transfer material S passes.

The left and right side plates 32*a* and 32*b* have bending also at their front (an inserting side of the photosensitive drum 1) to assure high rigidity as units. The left and right side plates 32*a* and 32*b* are formed with eight first openings (notches) 34 (34*a* to 34*h*) corresponding to the bending portions, and on the same surface as the first opening 34, eight second openings 35 (35*a* to 35*h*) are similarly formed substantially in the horizontal direction.

On a back side of the left and right side plates 32*a* and 32*b*, a back stay 36 is positioned and secured by screws such as to bridge the left and right side plates 32*a* and 32*b*, and the back stay 36 is formed with four third openings 37 (37*a* to 37*d*) substantially in the horizontal direction of the openings 34 and 35.

Accordingly, the body frame is configured by positioning the above described left and right side plates 32*a* and 32*b*, bottom plate 33, back stay 36 and stay (not shown) with accuracy and secured by screws.

Next, a method of positioning image-formation systems (the photosensitive drum 1 and scanner unit 3) will be described.

A photosensitive drum unit with the bearing 31 integrally incorporated is inserted from the direction of arrow of FIG. 2 to the first opening 34.

Figure 4:
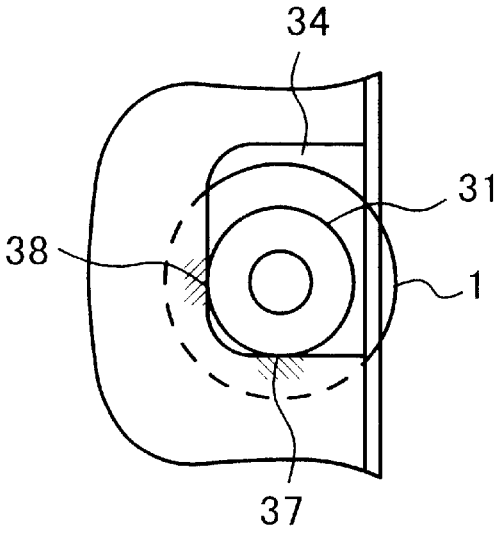
FIG. 4 is a side view partly showing a positioning portion of the photosensitive drum of the image forming apparatus according to the first embodiment of the present invention.

FIG. 4 is a partly enlarged view of a positioning portion of the photosensitive drum. As shown in this figure, the bearing 31 is configured by a ball bearing and positioned by being pressed on abutment surfaces 37 and 38 of the first opening 34. Accordingly, defining pitches between the hatched abutment surfaces 37 and 38 and other three portions with accuracy can minimize tilt aberration of a printed image.

Figure 6:
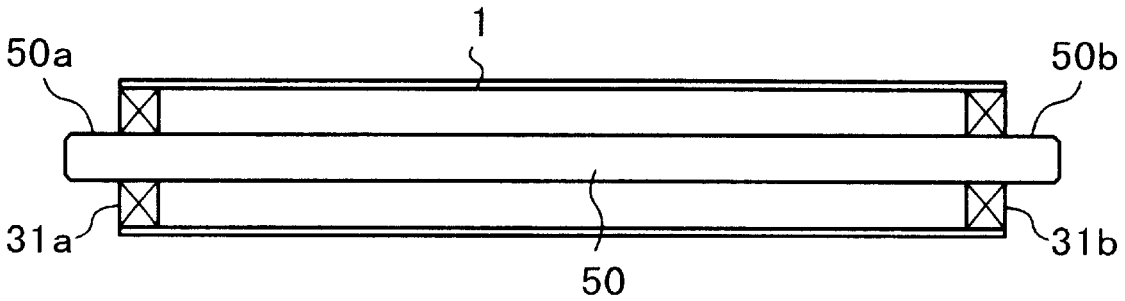
FIG. 6 is a sectional view of the photosensitive drum of the image forming apparatus according to the first embodiment of the present invention.

As shown in FIG. 6, the same effect can be obtained by pressing the bearing (ball bearing) 31 in the both ends of the photosensitive drum 1, rotatably fitting a through axis 50 in an inner diameter of the bearing 31 to be mounted thereto, and pressing both ends 50*a* and 50*b* of the through axis 50 against the abutment surfaces 37 and 38 of the first opening 34 to be positioned there. For the bearing 31, a slide bearing can be adopted by using slidable resins such as polyacetal.

Next, a method of pressing the photosensitive drum 1 will be described.

As shown in FIG. 3, an axis 39 is secured to the left and right side plates 32*a* and 32*b* and a torsion coil spring 40 is supported by the axis 39, and the torsion coil spring 40 is secured by its end 40*a* fitting into a hole 41 of the left and right side plates 32*a* and 32*b*. In the absence of the photosensitive drum 1, the rotational direction of the torsion coil spring 40 is controlled by a bent portion 42*a* from the left and right side plates 32*a* and 32*b*. When the photosensitive drum 1 is inserted, the torsion coil spring 40 is rotated in the counterclockwise direction contrary to its force, and positioned as shown in FIG. 3 when having passed the bearing 31 to press the bearing 31 by approximately 1 kgf power in the direction of arrow.

Figure 5:
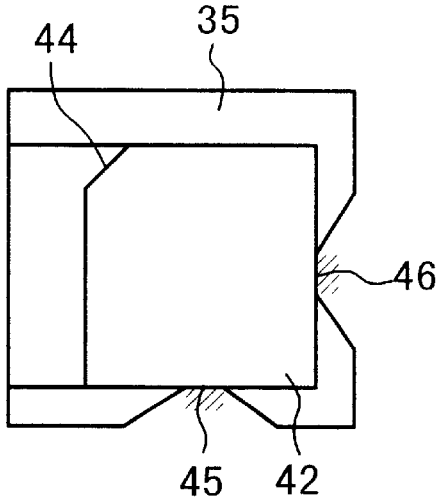
FIG. 5 is a side view partly showing a positioning portion of the scanner unit of the image forming apparatus according to the first embodiment of the present invention.

On the other hand, the scanner unit 3 is formed to be longitudinally longer than the pitch between the left and right side plates 32*a* and 32*b*, and a projection 42 is mounted to be projected outwardly from the second opening 35. At that time, pressing the projection 42 against hatched abutment surfaces 45 and 46 in FIG. 5 positions the scanner unit 3. For this reason, defining positional relationship of the abutment surfaces 45 and 46 with corresponding abutment surfaces 37 and 38 of the photosensitive drum 1 with accuracy can minimize tilt aberration of a printed image.

As shown in FIG. 3, the scanner unit 3 is pressed by a compression spring 43 such that inclined plane 44 of the projection 42 is pressed 45° downwardly by approximately 1 kgf power. This ensures the projection 42 pressed against the abutment surfaces 45 and 46 to thereby position the scanner unit 3.

Similar pressing is carried out in the back side of the scanner unit 3. The detail thereof will be described in FIG. 7.

Figure 7:
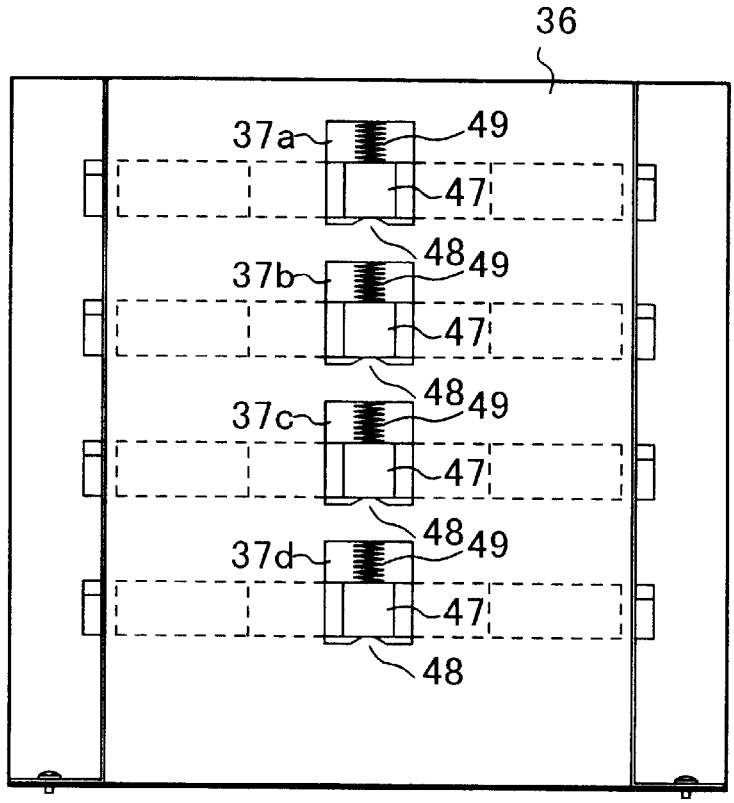
FIG. 7 is a rear view of the body frame of the image forming apparatus according to the first embodiment of the present invention.

FIG. 7 is a view of the image forming apparatus body seen from its back side (opposite the inserting direction of the photosensitive drum 1), and as shown in this figure, the back stay 36 is formed with the third openings 37 (37*a* to 37*d*) at four places and the scanner unit 3 is mounted such that a projection 47 formed at the back side thereof is projected outwardly from the openings 37 (37*a* to 37*d*). At that time, pressing the projection 47 against the abutment surface 48 shown in FIG. 7 positions the back side of the scanner unit 3. The back side of the scanner unit 3 is pressed by the compression spring 49. The compression spring 49 is mounted such that one end thereof is mounted on the end of the third opening 37 and that the other end is mounted on the top surface of the projection 47 of the scanner unit 3, which presses the scanner unit 3 by approximately 1 kgf power.

In this way, the scanner unit 3 is supported at three points by the image forming apparatus body and positioned by an urge of the compression springs 43 and 49 without securing the screws. Therefore, the scanner unit 3 is not at all influenced by distortion of the body frame, and when the apparatus body is distorted because of being installed on an uneven floor, the scanner unit 3 can perform stably.

Next, a method of manufacturing the left and right side plates 32*a* and 32*b* will be described.

Figure 8:
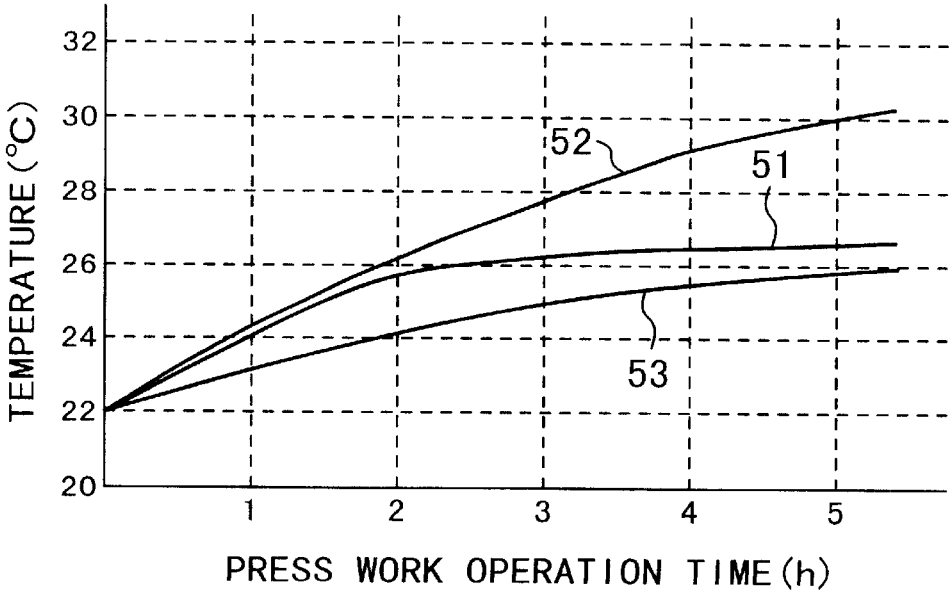
FIG. 8 is a diagram showing temperature variations of each element in press work operation time.

The left and right side plates 32*a* and 32*b* are required to have positional accuracy in the order of 10 μm so that influence of the temperature variations of a workpiece, a pressing mold and a pressing machine cannot be ignored. The temperature variation of each element is shown in FIG. 8. The workpiece is kept in a work place so that its temperature tends to conform to the environmental temperature. Namely, as shown by a curve 51 in FIG. 8, the temperature is the lowest in the morning and keeps rising in compliance with the environmental temperature so that a temperature difference between the morning and evening is about 4.5° C. As shown by a curve 52, it is confirmed by an experiment that the temperature of the pressing mold keeps rising by friction between the workpiece and mold due to a continuous press work and that the temperature rises approximately 8° C. in 5 hours. In addition, as shown by a curve 53, the temperature of the pressing machine varies by heat from its moving part and electric control part. The temperature variation of the pressing machine is the smallest because of its large heat capacity and the presence of lubricant.

In this way, there is always temperature variation in each part and each variation has a different pattern. All three elements are made of iron so that they have the same coefficient of linear expansion (0.00001116 mm/°C. mm) but their sizes go wrong in the order of 10 μm.

For example, in the state shown in FIG. 8 which is obtained by the experiment, the temperature of the mold is approximately 4° C. different from the temperature of the workpiece. In this case, the hole of 300 mm pitch is 13 μm (=300 mm×4° C.×0.00001116 (coefficient of linear expansion)) shorter. The temperature difference of 4° C. usually occurs in the press work and the temperature difference per se always varies between the morning and evening, and the summer and winter.

Figure 9:
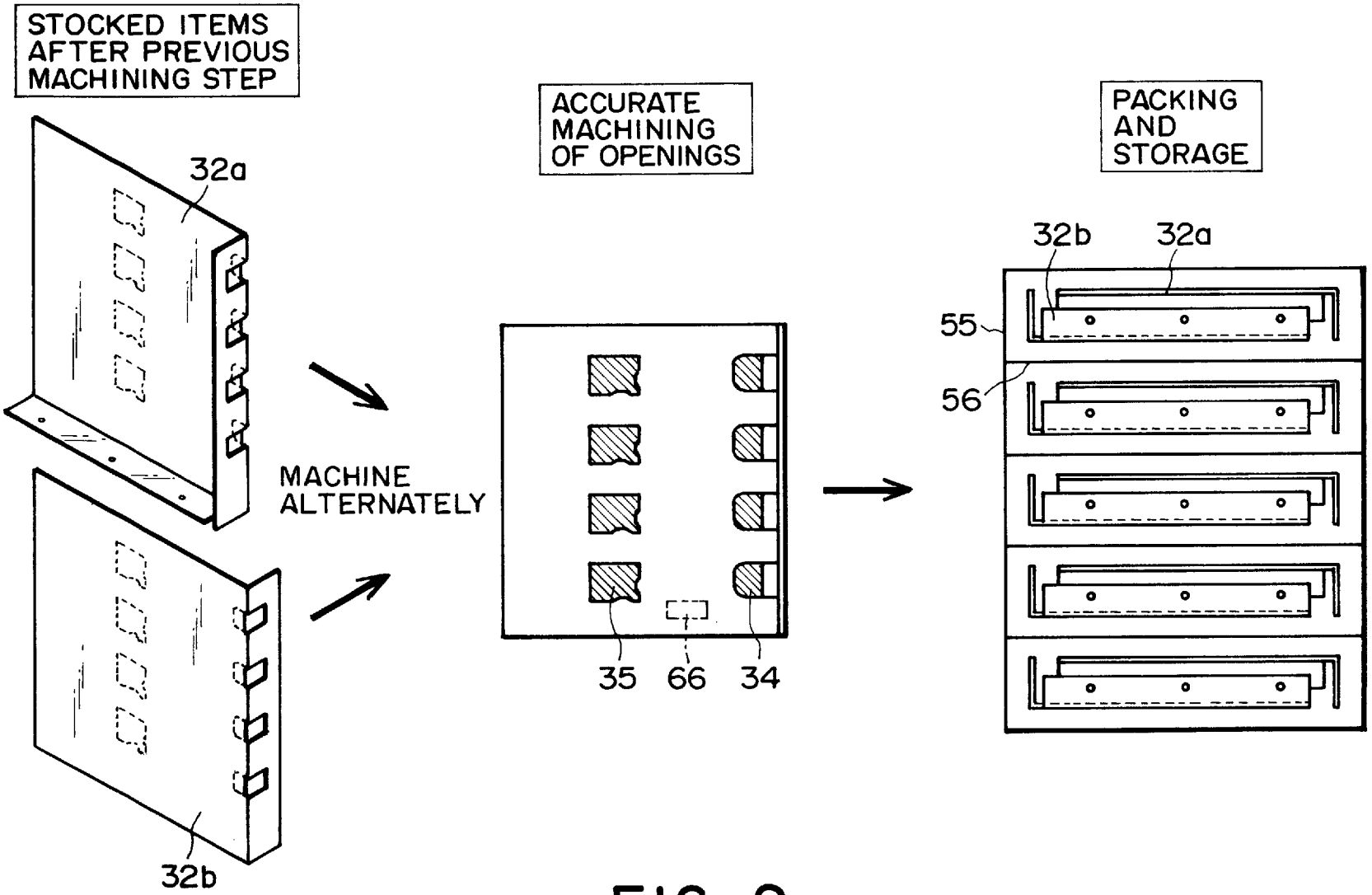
FIG. 9 is a view showing a machining procedure and a method of storage of right and left side plates of the image forming apparatus according to the first embodiment of the present invention.

Next, machining procedure of the left and right side plates 32*a* and 32*b* is shown in FIG. 9.

First, an item after a previous machining step except machining of the first openings 34 (4 places) and second openings 35 (4 places) is stocked for the left side plate 32*a*. Similar item is stocked for the right side plate 32*b*. The left and right side plates 32*a* and 32*b* actually have various openings machined, which are omitted in FIG. 9. In FIG. 9, a broken lines show openings to be formed in later machining step.

Both stocked items after previous machining steps are stocked at room temperature approximately a day in order to have their temperature even. Stocking the items near the pressing machine to be used in the later machining steps can minimize the temperature variation which occurs during their flow.

Then, the press work of the first opening 34 and second opening 35 is carried for the item which temperature is made even (accurate machining of openings). Since the left and right side plates 32*a* and 32*b* are machined using the same mold, the left side plate 32*a* is set in the pressing machine with the bent surface up and the 32*b* is set with the bent surface down to be machined. The press work is always carried out alternately one by one such that one left side plate 32*a* is machined, then that one right side plate 32*b* is machined, and then that one left side plate 32*a* is machined.

The left side item after previous machining step and the right side item after previous machining step have the same temperature, and the temperature of the pressing mold and pressing machine is the same as that of the workpiece at the beginning of machining. As shown in FIG. 8, the temperatures of the workpiece, pressing mold, and pressing machine, respectively vary in different manner.

Whenever the material is processed, however, two items continuously machined have almost the same temperature relationship of each element (the workpiece, pressing mold and pressing machine). According to this, the pair of left and right side plates 32*a* and 32*b* continuously machined have aberration about tens of μm a basic size by temperature factors, but there is no difference in size between the left and right side plates 32*a* and 32*b* continuously machined. In this embodiment, the difference is minimized by alternately machining, while depending upon the required difference in size between the right and left, the difference in size between the right and left can be minimized more remarkably than in a conventional machined item by alternately machining the items every 10 to 100 pieces.

As shown in FIG. 9, the left and right side plates 32*a* and 32*b* alternately machined are packed in a packing box 55. The packing box 55 is comparted by partitions 56, and the left and right side plates 32*a* and 32*b* are stored in sets to be put in products. The order of machining is controlled by giving serial numbers 66 to the left and right side plates 32*a* and 32*b* in the order of being machined. This facilitates control before inputting products and enables correct products to be input by checking the number. Means for giving the serial numbers 66 is such as imprinting and stamping.

Namely, the most important object of alternate pressing and controlling in pair is to eliminate the difference in size by machining the left and right side plates, 32*a* and 32*b* under the same condition of temperature relationship between each element.

The feature of the present invention is that the direction of punching burrs is the same at opening portions because the opening portions in the left and right side plates 32*a* and 32*b* are punched by a common pressing mold. In this embodiment, the punching burr of the left side plate 32*a* is projected outwardly of the apparatus body and the punching burr of the right side plate 32*b* is projected inwardly. The right side plate 32*b* is likely to be touched by a user so that the step of punching the burr is necessary for protecting the user. Generally, for coping with the necessity at low cost, a method of cutting to the face in the pressing step and squashing the punching burr is used.

However, the cutting to the face work is likely to lower the accuracy in size. For this reason, in this embodiment, a resin component is arranged near the punching burr without cutting to the face work so that the user cannot touch the punching burr.

An end surface of the opening is the surface for positioning the photosensitive drum 1 and the scanner unit 3. In order to increase the surfaces for positioning, a shaving work is effective in accurate machining of openings.

Figure 10:
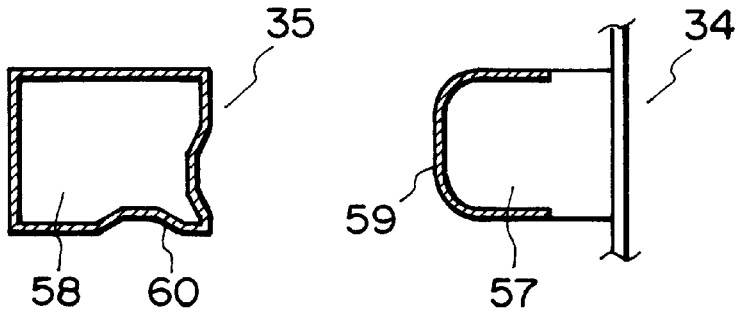
FIG. 10 is a sectional view partly showing a shaving work of right and left side plates of the image forming apparatus according to the first embodiment of the present invention.

In FIG. 10, the sections of the first opening 34 and second opening 35 are shown in order to describe the shaving work. As shown in FIG. 10, also in this embodiment, prepared openings 57, 58 are machined in a previous machining step, and the shaving work wherein punching stocks 59 and 60 are shaved is carried out in a later machining step. The thickness of the punching stocks 59 and 60 are preferably 5 to 100% of that of the plate. In this embodiment, the metal plate 1.2 mm thick is used and the punching stocks 59 and 60 are set approximately 100 $\mu$m (approximately 8%). According to this, a shearing face 20 to 40% of thickness generally obtained by punching becomes more than 70% and reduction of surface pressure applied to the positioning portion and increased strength against shock can be attained. Further, reduction of load applied to the pressing mold extends a die life.

<Embodiment 2>

Figure 11:
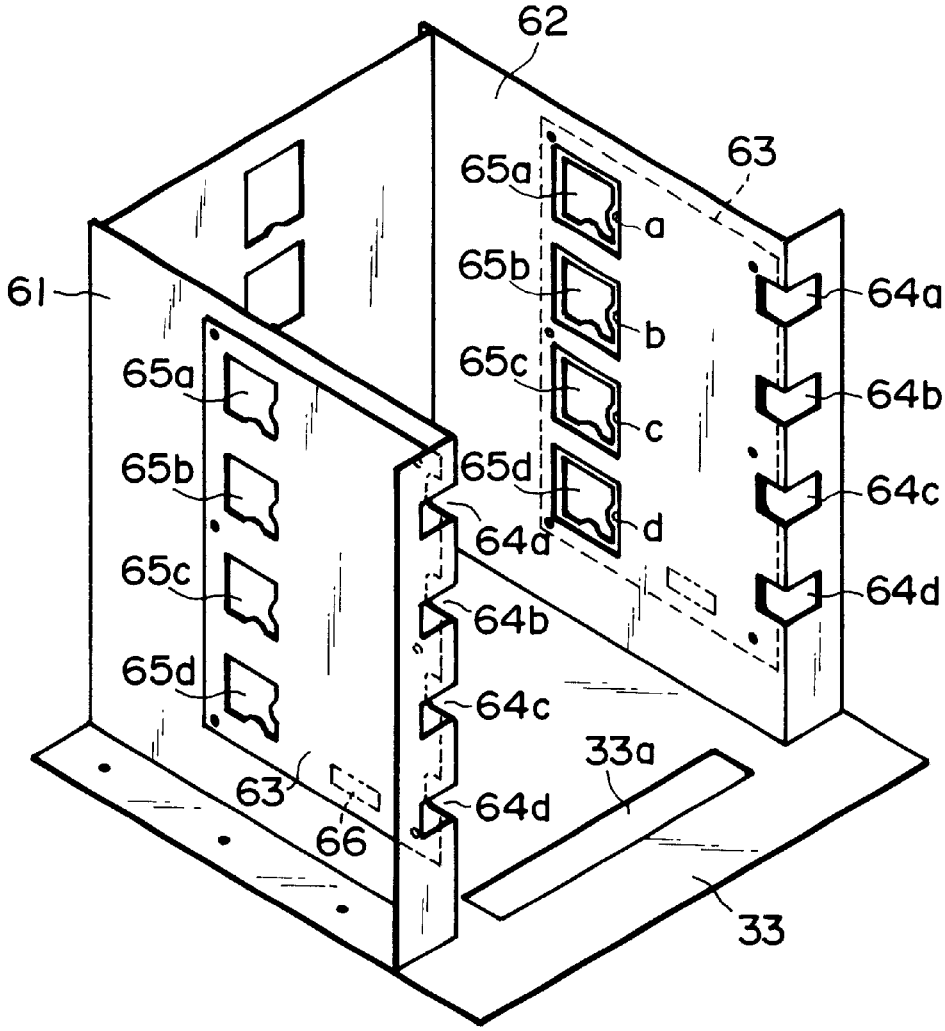
FIG. 11 is a perspective view showing a configuration of a body frame of the image forming apparatus according to a second embodiment of the present invention.
Figure 12A:
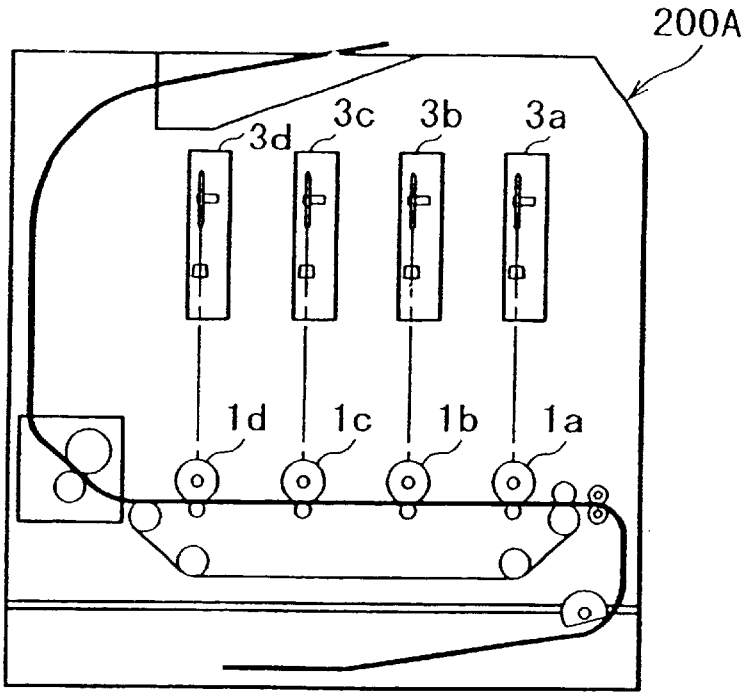
FIG. 12A PRIOR ART
FIGS. 12A and 12B are sectional views of a conventional full color image forming apparatus.
Figure 12B:
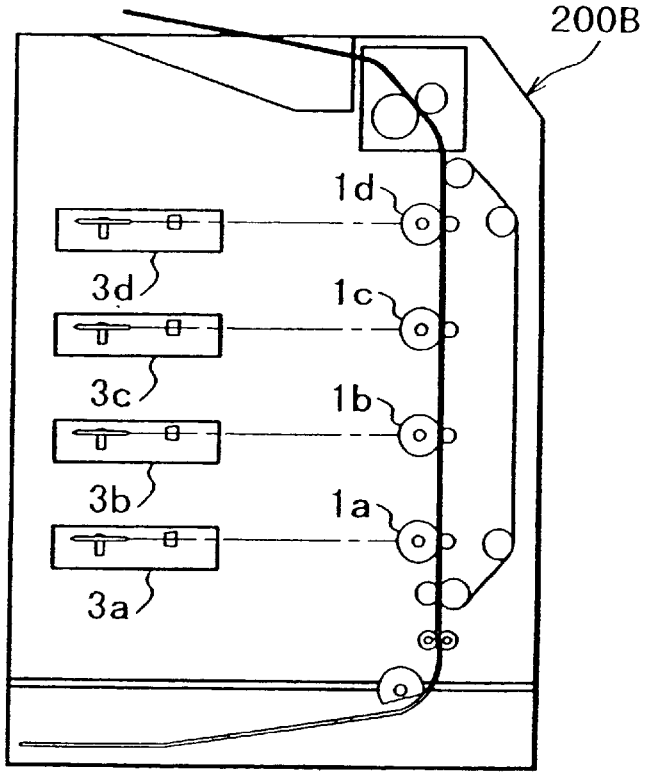
FIG. 12B PRIOR ART
Figure 13:
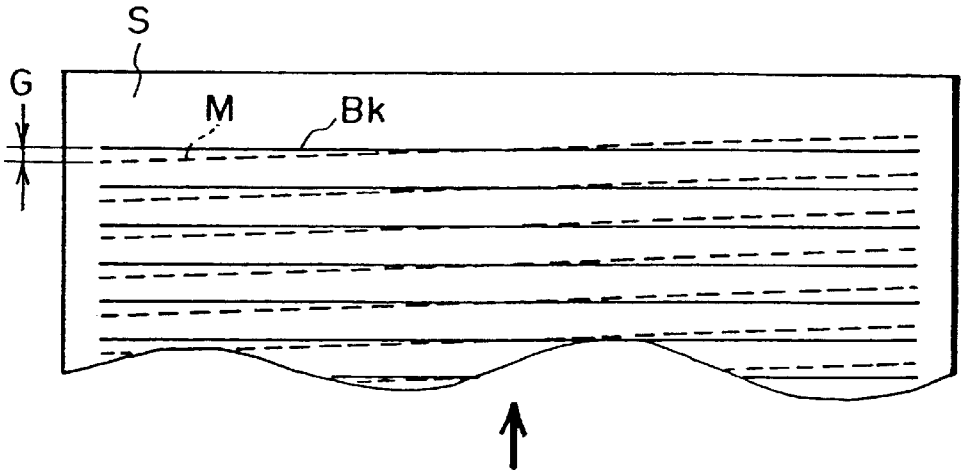
FIG. 13 is a view showing an example of defects in an image.
Figure 14:
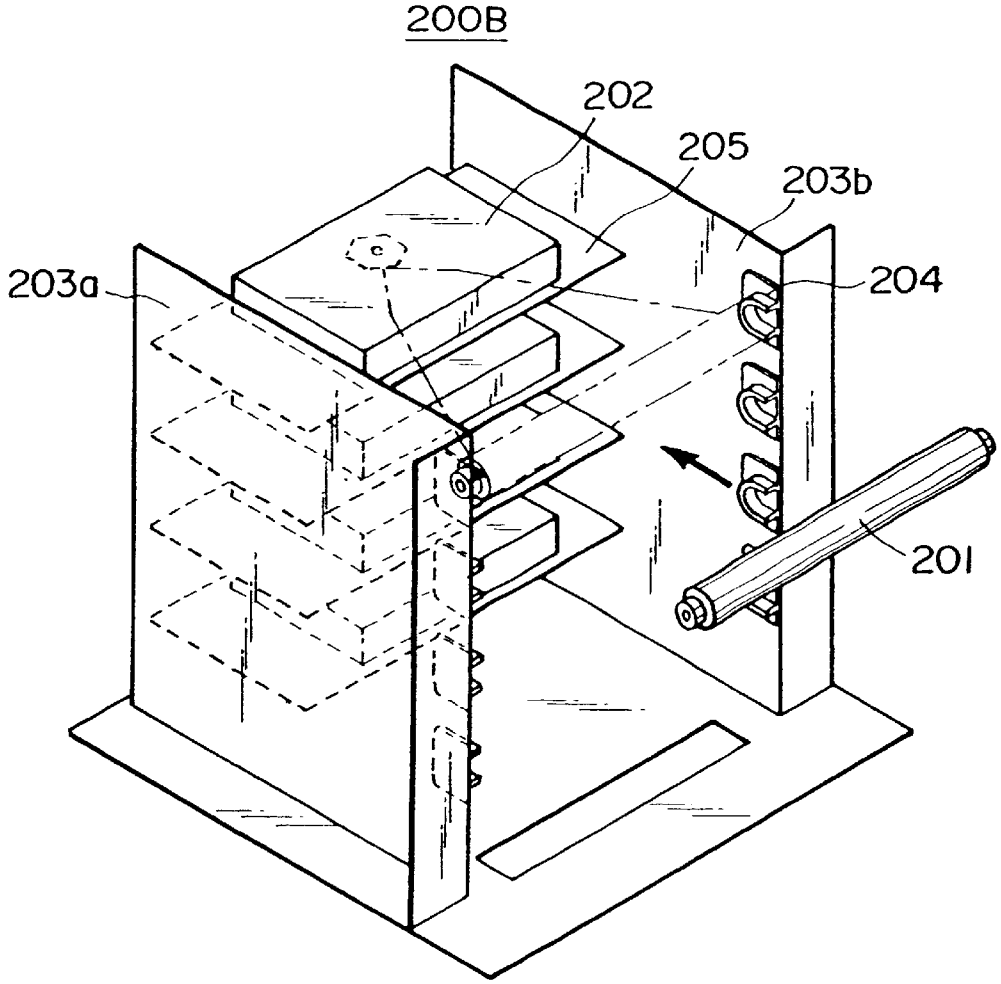
FIG. 14 PRIOR ART
FIG. 14 is a perspective view showing a frame structure of a conventional image forming apparatus.

Next, the second embodiment of the present invention will be described with reference to FIG. 11. FIG. 11 is a perspective view of a body frame of a full color image forming apparatus according to the present embodiment. In the description of this embodiment, the same members and the like as in the first embodiment are referred to by the same reference numerals and their descriptions will be omitted.

As shown in FIG. 11, a left side plate 61 and right side plate 62 are secured to the bottom plate 33 by screws in the same way as in the first embodiment. A positioning plate 63 is secured to the left and right side plates 61 and 62 by the screws from outside at six places. The positioning plate 63 is a flat plate made of a metal plate 1.2 mm thick and has first openings 64 (64*a* to 64*d*) for positioning the photosensitive drum 1 and second openings 65 (65*a* to 65*d*) for positioning the scanner unit 3. The methods of positioning and pressing the photosensitive drum 1 and the scanner unit 3 are the same as that in the first embodiment, but both photosensitive drum 1 and scanner unit 3 have escape openings a, b, c, d opening on the left and right side plates 61 and 62 and which are larger than the second openings 65 (65*a* to 65*d*) so as to abut the positioning plate 63.

In this embodiment, the machining procedures of the left and right side plates 61 and 62 are not controlled and the problem of machining condition is tried to be solved by controlling components of the positioning plate 63.

Namely, the positioning plate 63 is controlled in pair in the order of being pressed and the pair is input in the product. According to this, the positions of the first opening 64 and second opening 65 are not influenced by the machining condition and the difference in the positional relationship is minimized. This results in ensuring parallelism of each photosensitive drum 1 and positional relationship of the scanner unit 3 and the photosensitive drum 1 with accuracy.

As the same as the first embodiment, the shearing face can be obtained by shaving the first opening 64 and second opening 65, which enables increase in strength of the positioning portion and reduction of load of the pressing mold.

Further, in this embodiment, the positioning plate 63 is added and the cost of components is raised, but the components can be easily stored since the components to be stored is small and of a simple shape. In addition, the simple shape of the positioning 63 increases efficiency in pressing process, namely, enables press work with high production ability of the transfer and progressive die type.

What is claimed is:

1. An image forming apparatus comprising:

a plurality of image bearing members;

a plurality of image writing means for writing an image onto each of said image bearing member; and a frame for supporting a plurality of said image bearing members and a plurality of said image writing means, said frame having a plurality of first holding parts for holding both ends of each of said image bearing members and a plurality of second holding parts for holding both ends of each of said image writing means.

2. An image forming apparatus according to claim 1, wherein said frame further comprises a plurality of third holding parts for holding back parts of each of said image writing means.

3. An image forming apparatus according to claim 1, wherein each of said first holding parts is an end of a notch provided on said frame.

4. An image forming apparatus according to claim 1, wherein each of said second holding parts is an end of a notch provided on said frame.

5. An image forming apparatus according to claim 2, wherein each of said third holding parts is an end of a notch provided on said frame.

6. An image forming apparatus according to claim 3, wherein said frame is bent at a position of the notch having said first holding parts.

7. An image forming apparatus according to claim 1, further comprising urging means for urging said image bearing members against said first holding parts.

8. An image forming apparatus according to claim 1, further comprising urging means for urging said image writing means against said second holding parts.

9. An image forming apparatus according to claim 2, further comprising urging means for urging said image writing means against said third holding parts.

10. An image forming apparatus according to claim 1, wherein said image bearing members hold a bearing at their both ends, and wherein said first holding parts hold said image bearing members via said bearing.

11. An image forming apparatus according to claim 1, wherein said image bearing members are removable to said first holding parts.

12. An image forming apparatus according to claim 1, further comprising a plurality of units removable to said frame, each of said image bearing members being an component of each of said units.

13. An image forming apparatus according to claim 12, wherein each of said units holds both ends of each of said image bearing members, and wherein each of said first holding parts holds an image bearing member holding part of each of said units.

14. An image forming apparatus according to claim 12, wherein said units further comprise charging means for charging said image bearing members and developing means for developing a latent image formed on said image bearing members.

15. An image forming apparatus according to claim 14, wherein said units further comprise cleaning means for cleaning said image bearing members.

16. An image forming apparatus according to claim 2, wherein said image writing means emit laser light in response to an image signal, and wherein said third holding parts hold a casing of said image writing means.

17. An image forming apparatus according to claim 1, wherein said frame is configured from a pressed metal plate.

18. An image forming apparatus according to claim 17, wherein a burr of said first and second holding parts formed on the metal plate at an end of said image bearing members project inwardly of the apparatus, and wherein a burr of said first and second holding parts formed on the metal plate at the other end project outwardly of the apparatus.

19. An image forming apparatus according to claim 1, wherein said frame has two side plates, whereto plates formed with said first and second holding parts being mounted, respectively.

* * * * *

UNITED STATES PATENT AND TRADEMARK OFFICE

CERTIFICATE OF CORRECTION

PATENT NO. : 6,483,527 B2
DATED : November 19, 2002
INVENTOR(S) : Kaneko et al.

It is certified that error appears in the above-identified patent and that said Letters Patent is hereby corrected as shown below:

Title page,
Item [57], ABSTRACT, "a" (second occurrence) should be deleted.

Column 1,
Line 30, "are," should read -- are --.

Column 2,
Line 34, "onto:" should read -- onto --.

Column 4,
Line 47, "and," should read -- and --.

Column 5,
Line 29, "the," should read -- the --.

Column 9,
Line 8, "plates," should read -- plates --.

Column 10,
Line 35, "member;" should read -- members; --.

Column 11,
Line 10, "being an" should read -- being a --.

UNITED STATES PATENT AND TRADEMARK OFFICE

CERTIFICATE OF CORRECTION

PATENT NO. : 6,483,527 B2
DATED : November 19, 2002
INVENTOR(S) : Kaneko et al.

It is certified that error appears in the above-identified patent and that said Letters Patent is hereby corrected as shown below:

Column 12,
Line 13, "project" should read -- projects --;
Line 15, "project" should read -- projects --.

Signed and Sealed this

Eighth Day of July, 2003

JAMES E. ROGAN
*Director of the United States Patent and Trademark Office*